US007132378B2

(12) United States Patent
Kreider et al.

(10) Patent No.: US 7,132,378 B2
(45) **Date of Patent: *Nov. 7, 2006**

(54) FABRICS HAVING A TOPICALLY APPLIED SILVER-BASED FINISH WITH A CROSS-LINKED BINDER SYSTEM FOR IMPROVED HIGH-TEMPERATURE WASH DURABILITY

(75) Inventors: Jason Kreider, Spartanburg, SC (US); Shulong Li, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 56 days.

This patent is subject to a terminal disclaimer.

(21) Appl. No.: 10/421,057

(22) Filed: Apr. 23, 2003

(65) Prior Publication Data

US 2004/0214490 A1 Oct. 28, 2004

(51) Int. Cl.
*B32B 5/22* (2006.01)

(52) U.S. Cl. ..... 442/117; 442/148; 442/123; 428/379; 428/389

(58) Field of Classification Search ..... 442/148, 442/117, 123; 428/379, 389
See application file for complete search history.

(56) References Cited

U.S. PATENT DOCUMENTS 4,906,464 A * 3/1990 Yamamoto et al. ..... 424/489
5,709,870 A * 1/1998 Yoshimura et al. ..... 424/404
5,941,369 A * 8/1999 Katsura et al. ..... 198/847
6,013,275 A * 1/2000 Konagaya et al. ..... 424/443
6,126,931 A * 10/2000 Sawan et al. ..... 424/78.09
6,479,144 B1 * 11/2002 Petrea et al. ..... 428/379
6,641,829 B1 * 11/2003 Green et al. ..... 424/405
6,916,480 B1 * 7/2005 Anderson et al. ..... 424/404

FOREIGN PATENT DOCUMENTS

JP 09013279 * 1/1997

* cited by examiner

*Primary Examiner*—Cheryl A. Juska
*Assistant Examiner*—A B Sperty
(74) *Attorney, Agent, or Firm*—Terry T. Moyer; Brenda D. Wentz

(57) ABSTRACT

Improvements in the high-temperature wash durability and discoloration levels for fabrics having topically applied silver-ion treatments (such as ion-exchange compounds, like zirconium phosphates, glasses and/or zeolites) are provided. Such solid compounds are generally susceptible to discoloration and, due to the solid nature thereof, are typically easy to remove from topical surface applications, particularly when laundered at elevated temperatures. The inventive treatment requires the presence of a specific cross-linked binder, either as a silver-ion overcoat or as a padded-on component of a cross-linked binder admixed with the silver-ion antimicrobial compound. In addition, specific metal halide additives (preferably substantially free from sodium ions) may be utilized to combat the discolorations typical of such silver-ion formulations. As a result, high-temperature wash durability, discoloration levels, or both, can be improved to the extent that after a substantial number of standard launderings and dryings, the inventive treatment does not wear away in any appreciable amount and the color of the treatment remains substantially the same as when first applied. The particular treatment method, as well as the treated fabrics are also encompassed within this invention.

2 Claims, No Drawings

FABRICS HAVING A TOPICALLY APPLIED SILVER-BASED FINISH WITH A CROSS-LINKED BINDER SYSTEM FOR IMPROVED HIGH-TEMPERATURE WASH DURABILITY

FIELD OF THE INVENTION

This invention relates to improvements in the high-temperature wash durability and discoloration levels for fabrics having topically applied silver-ion treatments (such as ion-exchange compounds, like zirconium phosphates, glasses and/or zeolites). Such solid compounds are generally susceptible to discoloration and, due to the solid nature thereof, are typically easy to remove from topical surface applications, particularly when laundered at elevated temperatures. The inventive treatment requires the presence of a specific cross-linked binder, either as a silver-ion overcoat or as a padded-on component of a cross-linked binder admixed with the silver-ion antimicrobial compound. In addition, specific metal halide additives (preferably substantially free from sodium ions) may be utilized to combat the discolorations typical of such silver-ion formulations. As a result, high-temperature wash durability, discoloration levels, or both, can be improved to the extent that after a substantial number of standard launderings and dryings, the inventive treatment does not wear away in any appreciable amount and the color of the treatment remains substantially the same as when first applied. The particular treatment method, as well as the treated fabrics are also encompassed within this invention.

DISCUSSION OF THE PRIOR ART

There has been a great deal of attention in recent years given to the hazards of bacterial contamination from potential everyday exposure. Noteworthy examples of such concern include the fatal consequences of food poisoning due to certain strains of *Eschericia coli* being found within undercooked beef in fast food restaurants; *Salmonella* contamination causing sicknesses from undercooked and unwashed poultry food products; and illnesses and skin infections attributed to *Staphylococcus aureus, Klebsiella pneumoniae*, yeast, and other unicellular organisms. With such an increased consumer interest in this area, manufacturers have begun introducing antimicrobial agents within various household products and articles. For instance, certain brands of polypropylene cutting boards, liquid soaps, etc., all contain antimicrobial compounds. The most popular antimicrobial for such articles is triclosan. Although the incorporation of such a compound within liquid or polymeric media has been relatively simple, other substrates, including the surfaces of textiles and fibers, have proven less accessible. There is a long-felt need to provide effective, durable, and long-lasting antimicrobial characteristics for textile surfaces, in particular on apparel fabrics, and on film surfaces. Such proposed applications have been extremely difficult to accomplish with triclosan, particularly when wash durability is a necessity (triclosan easily washes off any such surfaces). Furthermore, although triclosan has proven effective as an antimicrobial compound, exposuret to chlorine bleach will dramatically reduce, if not remove, the efficacy which makes the utilization of such with fibers, films, and textile fabrics for apparel uses highly undesirable. Furthermore, there are commercially available textile products comprising acrylic and/or acetate fibers co-extruded with triclosan (for example Celanese markets such acetate fabrics under the name Microsafe™ and Acordis markets such acrylic fibers, either under the tradename Amicor™). However, such an application is limited to those types of fibers; it does not work specifically for and within polyester, polyamide, cotton, spandex, etc., fabrics. Furthermore, this co-extrusion procedure is very expensive.

Silver-containing inorganic microbiocides have recently been developed and utilized as antimicrobial agents on and within a plethora of different substrates and surfaces. In particular, such microbiocides have been adapted for incorporation within melt spun synthetic fibers, as taught within Japanese unexamined Patent Application No. H11-124729, in order to provide certain fabrics which selectively and inherently exhibit antimicrobial characteristics. Furthermore, attempts have been made to apply such specific microbiocides on the surfaces of fabrics and yarns with little success from a durability standpoint. A topical treatment with such compounds has never been successfully applied as a durable finish or coating on a fabric or yarn substrate. Although such silver-based agents provide excellent, durable, antimicrobial properties, to date such is the sole manner available within the prior art of providing a long-lasting, wash-resistant, silver-based antimicrobial textile. However, such melt spun fibers are expensive to make due to the large amount of silver-based compound required to provide sufficient antimicrobial activity in relation to the migratory characteristics of such a compound within the fiber itself to its surface. A topical coating is also desirable for textile and film applications, particularly after finishing of the target fabric or film. Such a topical procedure permits treatment of a fabric's individual fibers prior to or after weaving, knitting, and the like, in order to provide greater versatility to the target yarn without altering its physical characteristics. Such a coating, however, must prove to be wash durable, particularly for apparel fabrics, and, particularly for high-temperature laundering procedures (for quicker cleanings, as well as increased chances of initial bacterial and/or other micoorganism contamination) in order to be functionally acceptable. Furthermore, in order to avoid certain problems, it is highly desirable for such a metallized treatment to be electrically non-conductive on the target fabric, yarn, and/or film surface. With the presence of metals and metal ions, such a wash durable, non-electrically conductive coating has not been available in the past. Such an improvement would thus provide an important advancement within the textile, yarn, and film art. Although antimicrobial activity is one desired characteristic of the inventive metal-treated fabric, yarn, or film, this is not a required property of the inventive article. Odor-reduction, heat retention, distinct colorations, reduced discolorations, improved yarn and/or fabric strength, resistance to sharp edges, etc., are all either individual or aggregate properties which may be accorded the user of such an inventive treated yarn, fabric, or film.

Furthermore, topical applications of silver-ion based compounds generally exhibit aesthetically displeasing discolorations due to oxidation of the silver-ions themselves. Typically, a variety of hues (from yellow to grey to black) are prominent during and after exposure to atmospheric conditions. Thus, there remains a need to provide improvements for such topical treatments as well. To date, the difficulties with discoloration have gone noticed but unremedied.

DESCRIPTION OF THE INVENTION

It is thus an object of the invention to provide a simple manner of effectively treating a textile with a highly wash-durable antimicrobial silver-ion containing treatment. Another object of the invention is to provide an aesthetically pleasing metal-ion-treated textile which is highly wash durable within elevated temperature laundering procedures, substantially non-discoloring, non-irritating to skin, and which provides antimicrobial and/or odor control properties. Accordingly, this invention encompasses a non-electrically conductive fabric substrate having a surface, a portion of which is coated with a finish, wherein said finish comprises at least one silver-ion containing compound selected from the group consisting of silver zirconium phosphate, silver zeolite, silver glass, and any mixtures thereof, and at least one cross-linked binder material; wherein, optionally, said treated fabric exhibits a silver-ion release retention level of at least 5%, with an initial amount of available silver ion of at least 1000 ppb, as measured by a phosphate buffer comparison test, wherein said silver-ion release retention level is measured after at least 10 washes, said washes being performed in accordance with the wash procedure as part of a modified AATCC Test Method 130-1981 at at least 120° F. Also encompassed within this invention is a fabric substrate having a surface, a portion of which is coated with a non-electrically conductive finish, wherein said finish comprises at least one silver-ion containing compound selected from the group consisting of silver zirconium phosphate, silver zeolite, silver glass, and any mixtures thereof, and at least one cross-linked binder material; wherein said coated fabric exhibits a log kill rate for *Staphylococcus aureus* after 24 hour exposure in accordance with AATCC Test Method 100-1993 of at least 1.5, wherein said log kill rate is measured after at least 10 washes, said washes being performed in accordance with the wash procedure as part of a modified AATCC Test Method 130-1981 at at least 120° F. Further encompassed by this invention is a A fabric substrate having a surface, a portion of which is coated with a finish, wherein said finish comprises at least one silver-ion containing compound selected from the group consisting of silver zirconium phosphate, silver zeolite, silver glass, and any mixtures thereof, at least one cross-linked binder material selected from the group consisting of at least one polyurethane binder, at least one acrylic binder, and any mixtures thereof, and at least one halide-ion containing compound, wherein the molar ratio of halide ions to silver ions is within the range of from 1:10 to 5:1, and wherein said finish is substantially free from alkali metal ions.

The wash durability test noted above is standard and, as will be well appreciated by one of ordinary skill in this art, is not intended to be a required or limitation within this invention. Such a test method merely provides a standard which, upon 10 washes in accordance with such, the inventive treated substrate will not lose an appreciable amount of its electrically non-conductive metal finish.

Nowhere within the prior art has such a specific treated substrate or method of making thereof been disclosed, utilized, or fairly suggested. The closest art is a product marketed under the tradename X-STATIC® which is a fabric article electrolessly plated with a silver coating. Such a fabric is highly electrically conductive and is utilized for static charge dissipation. Also, the coating alternatively exists as a removable silver powder finish on a variety of surfaces. The aforementioned Japanese patent publication to Kuraray is limited to fibers within which a silver-based compound has been incorporated through melt spun fiber techniques. Nowhere has such a wash-durable topical treatment as now claimed been mentioned or alluded to.

Any fabric may be utilized as the substrate within this application. Thus, natural (cotton, wool, and the like) or synthetic fibers (polyesters, polyamides, polyolefins, and the like) may constitute the target substrate, either by itself or in any combinations or mixtures of synthetics, naturals, or blends or both types. As for the synthetic types, for instance, and without intending any limitations therein, polyolefins, such as polyethylene, polypropylene, and polybutylene, halogenated polymers, such as polyvinyl chloride, polyesters, such as polyethylene terephthalate, polyester/polyethers, polyamides, such as nylon 6 and nylon 6,6, polyurethanes, polyaramids, such as KEVLAR® and NOMEX® from duPont, as well as homopolymers, copolymers, or terpolymers in any combination of such monomers, and the like, may be utilized within this invention. Nylon 6, Nylon 6,6, polyaramids, polypropylene, and polyethylene terephthalate (a polyester) are particularly preferred with the cross-linked binder systems of this invention, particularly due to the surface modifications provided by such cross-linked systems. As such, woven fabrics are most preferred as substrates of these fibers, with knit structures and nonwovens also possibilities, only to a lesser extent. Additionally, the target fabric may be coated with any number of different films, including those listed in greater detail below. Furthermore, the substrate may be dyed or colored to provide other aesthetic features for the end user with any type of colorant, such as, for example, poly(oxyalkylenated) colorants, as well as pigments, dyes, tints, and the like. Other additives may also be present on and/or within the target fabric or yarn, including antistatic agents, brightening compounds, nucleating agents, antioxidants, UV stabilizers, fillers, permanent press finishes, softeners, lubricants, curing accelerators, and the like. Particularly desired as optional and supplemental finishes to the inventive fabrics are soil release agents which improve the wettability and washability of the fabric. Preferred soil release agents include those which provide hydrophilicity to the surface of polyester. With such a modified surface, again, the fabric imparts improved comfort to a wearer by wicking moisture. The preferred soil release agents contemplated within this invention may be found in U.S. Pat. Nos. 3,377,249; 3,540,835; 3,563,795; 3,574,620; 3,598,641; 3,620,826; 3,632,420; 3,649,165; 3,650,801; 3,652,212; 3,660,010; 3,676,052; 3,690,942; 3,897,206; 3,981,807; 3,625,754; 4,014,857; 4,073,993; 4,090,844; 4,131,550; 4,164,392; 4,168,954; 4,207,071; 4,290,765; 4,068,035; 4,427,557; and 4,937,277. These patents are accordingly incorporated herein by reference. Additionally, other potential additives and/or finishes may include water repellent fluorocarbons and their derivatives, silicones, waxes, and other similar water-proofing materials.

The particular treatment must comprise at least one type of silver-ion containing compounds, or mixtures thereof of different types. The term silver-ion containing compounds encompasses compounds which are either ion-exchange resins, zeolites, or, possibly substituted glass compounds (which release the particular metal ion bonded thereto upon the presence of other anionic species). The preferred silver-ion containing compound for this invention is an antimicrobial silver zirconium phosphate available from Milliken & Company, under the tradename ALPHASAN®. Other potentially preferred silver-containing antimicrobials in this invention is a silver zeolite, such as those available from Sinanen under the tradename ZEOMIC® AJ, or a silver glass, such as those available from Ishizuka Glass under the tradename IONPURE®, may be utilized either in addition to or as a substitute for the preferred species. Generally, such a metal compound is added in an amount of from about 0.01 to about 40% by total weight of the particular treatment composition; more preferably from about 0.05 to about 30%; and most preferably from about 0.1 to about 30%. Preferably this metal compound is present in an amount of from about 0.01 to about 5% owf, preferably from about 0.05 to about 3% owf, more preferably from about 0.1 to about 2% owf, and most preferably about 1.0% owf. The treatment itself, including any necessary binders, cross-linking agents for such binders, leveling agents, adherents, thickeners, and the like, is added to the substrate in an amount of about 0.01 to about 10% owf. Of particular interest are anti-soil redeposition polymers, such as certain ethoxylated polyesters PD-92 and DA-50, both available from Milliken & Company, or MILEASE®, available from Clariant.

The cross-linked binder material provides highly beneficial durability for the inventive yarns. Preferably, this component is a polyurethane-based binding agent, although other types, such as a permanent press type resin or an acrylic type resin, may also be utilized in combination, particularly, with the optional halide ion additive for discoloration reduction. The cross-linking agent utilized therewith may be selected from the group consisting of urea-based types, blocked isocyanates, epoxy-based compounds, melamine-formaldehydes, alkoxyalkylmelamines, and any mixtures thereof. Multifunctional cross-linking agents are particularly preferred for this invention. Such compounds generally exhibit an average of at least three reactive groups per molecule, thereby permitting higher efficiency and density for stronger and more reliable cross-linking capabilities. Specific types of cross-linking agents useful within this invention include (with non-limiting examples of such specific types within parentheses) modified ethylene urea (such as FREEREZ® PFK, from Freedom Textile Chemical, having about 44% solids content), blocked isocyanates (such as REPEARL® MF, from Mitsubishi International Corporation, having about 36% solids content), polyisocyanates (such as BAYHYDUR® 302, from Bayer, having about 99.8% solids content), epoxies (such as EPIREZ® 5003, from Resolution Performance Products, having about 55% solids content), melamine-formaldehyde condensates (such as AEROTEX® M3, from Noveon, having about 80% solids content), methylated melamine-formaldehydes (such as CYMEL® 301, from Cytec Industries, having about 98% solids content), and hexamethoxymethylmelamines (such as CYMEL® 385, having about 80% solids content), and carbodiimides. The epoxies are particularly effective for this purpose. The EPIREZ types (as listed above), as an example, exhibit a functionality of three for, as noted previously, stronger cross-linking capabilities, and therefore are exceptionally good for these desired characteristics. Alternatively, difunctional cross-linking agents, with high concentrations of reactive groups per unit weight are also possible. For example, a certain weight (grams) of resin containing one gram-equivalent of epoxide (otherwise known as WPE), characterizes the concentration of epoxide reactive groups. The aforementioned EPIREZ 5003 exhibits a WPE of 200, which is, as noted, highly effective. Such resins, epoxy or otherwise, with WPE measurements of 500 or less would thus be suitable for this invention. Most preferred would be those having a WPE less than about 250.

A catalyst is generally necessary to effectuate proper cross-linking of the target binder material, unless the cross-linking agent is self-catalyzed (such as the REPEARL®, EPIREZ®, and BAYHYDUR® types, above). The epoxies noted above are preferred. Possible catalysts are quite broad in number, although NACURE® 2547, from King Industries, was utilized as an added compound for this purpose within the examples below. Other types include Lewis acid compounds, such as magnesium chloride, and tertiary amines (such as benzyl dimethylamine). Such a catalyst is generally present in an amount of from 0.5–2% by weight of the cross-linking agent (if such a catalyst is necessary) when present on the target fabric. Magnesium (or other non-alkali metal cation) chloride may thus be added in sufficient amount to provide catalysis and discoloration reduction as further described herein (e.g., it may serve such a dual purpose, if desired).

In essence, such cross-linked resins provide high-temperature washfastness by adhering silver to the target yarn and/or fabric surface, with the cross-linked polyurethane to such an extent that elevated temperatures do not dissociate the cross-linking agent, thereby preventing removal within laundering procedures of the binder material. With the binder remaining in place, the silver-ion active antimicrobial is more readily retained as well, thereby providing wash durability results for such high-temperature applications.

The selected substrate may be any fabric comprising individual fibers or yarns of any typical source for utilization within fabrics, including natural fibers (cotton, wool, ramie, hemp, linen, and the like), synthetic fibers (polyolefins, polyesters, polyamides, polyaramids, acetates, rayon, acylics, and the like), inorganic fibers (fiberglass, boron fibers, and the like), and any blends thereof. Preferred are polyamide/cotton, polyaramid, cotton, and polyester. The yarn or fiber may be of any denier, may be of multi- or monofilament, may be false-twisted or twisted, or may incorporate multiple denier fibers or filaments into one single yarn through twisting, melting, and the like. The target fabrics may be produced of the same types of yarns discussed above, including any blends thereof. Such fabrics may be of any standard construction, including knit, woven, or non-woven forms. The inventive fabrics may be utilized in any suitable application, including, without limitation, apparel, upholstery, bedding, wiping cloths, towels, gloves, rugs, floor mats, drapery, napery, bar runners, textile bags, awnings, vehicle covers, boat covers, tents, and the like. The inventive fabric may also be coated, printed, colored, dyed, and the like.

The preferred procedures utilizing silver-ion containing compounds, such as either ALPHASAN®, ZEOMIC®, or IONPURE® as preferred compounds (although any similar types of compounds which provide silver ions may also be utilized), admixed with a binder and cross-linking agent within a pad bath, into which the target fabric is then immersed at elevated temperatures (i.e., above about 50° C.). Subsequently, the treated fabric is then squeezed through a nip roll and dried at a temperature between 160 and 400° F. depending on the nature of the fabric end-use.

In terms of wash durability, such a procedure was developed through an initial attempt at understanding the ability of such metal-ion containing compounds to attach to a fabric surface. Thus, a sample of ALPHASAN® was first exhausted from a dye bath on to a target polyester fabric surface. The treated fabric exhibited excellent log kill rate characteristics; however, upon washing in a standard laundry method (AATCC Test Method 130-1981, for instance), the antimicrobial activity was drastically reduced. Such promising initial results led to the inventive wash-durable antimicrobial treatment wherein the desired metal-ion containing compound would be admixed or overcoated with a binder resin on the target fabric surface. It was initially determined that proper binder resins could be selected from the group consisting of nonionic permanent press binders (i.e., cross-linked adhesion promotion compounds, including, without limitation, cross-linked imidazolidinones, available from Sequa under the tradename PERMA-FRESH®) or slightly anionic binders (including, without limitation, acrylics, such as RHOPLEX® TR3082 from Rohm & Haas). Other nonionics and slightly anionics were also possible, including melamine formaldehyde, melamine urea, ethoxylated polyesters (such as LUBRIL QCX™, available from Rhodia), and the like. However, it was found that the wash durability of such treated fabrics (in terms of silver-ion retention, at least) was limited. It was determined that greater durability was required for this type of application. Thus, these prior comparative treatments were measured against various other types. In the end, it was discovered that certain polyurethane binders (such as, preferably FREECAT® from Noveon, and WITCOBOND® from Crompton Corporation) and acrylic binders (such as HYSTRETCH® from BFGoodrich) permitted the even better wash durability to the solid silver-ion compound adhered to the target fabric surfaces, as discussed in greater detail below. However, with certain woven or knit fabrics, there are still some issues, particularly with wash durability in high temperature laundering procedures (e.g., 120° F. and higher). Thus, more stable, more reliable, less high temperature susceptible binder systems were necessarily developed. This led to the current cross-linked binder systems of the current invention.

Within the particular topical application procedures, the initial application of the silver-ion compound (preferably, ALPHASAN®) is thus preferably followed by a thin coating of cross-linked polyurethane-based binder resin to provide the desired high temperature wash durability characteristics for the silver-ion based antimicrobial and/or odor reducing treatment. With such specific cross-linked polyurethane-based binder materials utilized, the antimicrobial characteristics of the treated fabric remained very effective for the fabric even after as many as ten high temperature laundering procedures.

Also possible, and more effective in most situations as compared to the aforementioned binder resin overcoat, but still an acceptable method of providing a wash-durable antimicrobial metal-treated fabric surface, is the application of a silver-ion containing compound/polyurethane-based binder resin from a pad bath mixture followed by nip roll wringing of excess liquor and high temperature drying thereof. The contacting of such a combination is less efficacious from an antimicrobial activity standpoint than the other overcoat, but, again, still provides a wash-durable treatment with acceptable antimicrobial benefits. This mixture of compound/resin may also be applied through spraying, dipping, exhaustion, and the like. Although such a pad bath method is utilized for all of the examples, either inventive or comparative, described and followed herein, this method is by no means intended on limiting the scope of the claimed invention.

In terms of discoloration, it was noticed that silver-ion topical treatments were at times susceptible to yellowing, browning, graying, and, possibly, blacking after exposure to atmospheric conditions. As silver ions are generally highly reactive with free anions, and most anions that react with silver ions produce color, a manner of curtailing if not outright preventing problematic color generation upon silver ion interactions with free anionic species, particularly within dye bath liquids, was required. Thus, it was theorized that inclusion of an additive that was non-discoloring itself, would not react deleteriously with the cross-linked binder and/or silver-ion compound, and would, apparently, and without being bound to any specific scientific theory, react in such a manner as to provide a colorless salt with silver ions, was highly desired. Halide ions, such as from metal halides (magnesium chloride, for example) or hydrohalic acids (HCl for example) provide such results, apparently, with the exception that the presence of sodium ions (which are of the same valence as silver ions, and compete with silver ions for reaction with halide ions) should be avoided, since such components prevent the production of colorless silver halides, leaving the free silver ions the ability to react thereafter with undesirable anions. Thus, the presence of such monovalent sodium ions (as well as other monovalent alkali metal ions, such as potassium, cesium, and lithium, at times) does not provide the requisite level of discoloration reduction to the degree needed. In general, amounts of 1000 ppm or greater of sodium ions within the finish composition, particularly within the solvent (water, for example) are deleterious to the discoloration prevention of the inventive topically applied treatments. Thus, this threshold amount is encompassed by the term "substantially free from sodium ions" as it optionally pertains to this invention. Furthermore, the bivalent or trivalent (and some monovalent) metal halide counteracts some effects of sodium ion exposure if present in a sufficient amount within the finish composition. Thus, higher amounts of sodium or like alkali metal ions are present within the finish composition, higher amounts of metal halide (magnesium chloride, for example) can counterbalance such to the extent that discoloration can be properly prevented. Furthermore, all other metal ions (bivalents, trivalents, and the like, with bivalents, such as magnesium, most preferred) combined with halide anions (such as chloride, bromides, iodides, as examples, with chlorides most preferred), as well as acids (again, HCl, as well as HBr, and the like) are potential additives for discoloration prevention within this invention. The amount of chloride ion (concentrations) should be measured in terms of molar ratios with the free silver ions available within the silver-ion containing compound. A range of ratios from 1:10 (chloride to silver ion) to 5:1 (chloride to silver ion) should be met for proper activity; preferably this range is from 1:2 to about 2.5:1. Again, higher amounts of metal halide in molar ratio to the silver ions may be added to counteract any excess alkali metal ion amounts within the finish composition itself.

The preferred embodiments of these inventive fabric treatments (whether it be wash durable, non-discoloring, or both) are discussed in greater detail below.

DESCRIPTION OF THE PREFERRED EMBODIMENTS

The following examples further illustrate the present invention but are not to be construed as limiting the invention as defined in the claims appended hereto. All parts and percents given in these examples are by weight unless otherwise indicated.

Initially, solutions of ALPHASAN® (silver-based ion exchange compound available from Milliken & Company) were produced for topical application via pad bath application to target fabrics. These solutions, with comparatives as well, were as follows:

| Component | Amount (% by weight) |
|---|---|
| INVENTIVE EXAMPLE 1 | |
| Water | 95.15 |
| EPIREZ ® 5003 | 0.12 |
| Witcobond 293 | 4.04 |
| Alphasan RC5000 | 0.69 |

-continued

| Component | Amount (% by weight) |
|---|---|
| INVENTIVE EXAMPLE 2 | |
| Water | 96.35 |
| EPIREZ ® 5003 | 0.61 |
| Witcobond 281 | 2.49 |
| Alphasan RC5000 | 0.56 |
| INVENTIVE EXAMPLE 3 | |
| Water | 96.35 |
| EPIREZ ® 5003 | 0.61 |
| Witcobond 281 | 2.49 |
| Alphasan RC5000 | 0.56 |
| INVENTIVE EXAMPLE 4 | |
| Water | 96.35 |
| EPIREZ ® 5003 | 0.61 |
| Witcobond 293 | 2.49 |
| Alphasan RC5000 | 0.56 |
| INVENTIVE EXAMPLE 5 | |
| Water | 96.35 |
| EPIREZ ® 5003 | 0.61 |
| Witcobond 296 | 2.49 |
| Alphasan RC5000 | 0.56 |
| INVENTIVE EXAMPLE 6 | |
| Water | 95.10 |
| EPIREZ ® 5003 | 0.61 |
| Witcobond 736 | 4.17 |
| Alphasan RC5000 | 0.56 |
| INVENTIVE EXAMPLE 7 | |
| Water | 94.67 |
| EPIREZ ® 5003 | 0.39 |
| Witcobond 293 | 4.23 |
| Magnesium Chloride | 0.01 |
| AlphaSan RC5000 | 0.71 |
| COMPARATIVE EXAMPLE 1 | |
| Water | 95.27 |
| Witcobond 281 | 4.04 |
| ALPHASAN ® RC5000 | 0.69 |
| COMPARATIVE EXAMPLE 2 | |
| Water | 95.27 |
| Witconbond 293 | 4.04 |
| ALPHASAN ® RC5000 | 0.69 |
| COMPARATIVE EXAMPLE 3 | |
| Water | 95.27 |
| Witcobond 296 | 4.04 |
| ALPHASAN ® RC5000 | 0.69 |
| COMPARATIVE EXAMPLE 4 | |
| Water | 95.27 |
| Witcobond 736 | 4.04 |
| ALPHASAN ® RC5000 | 0.69 |

These solutions were then applied to sample fabrics (colored as noted below) via pad and nip rolls to give a wet pick up of about 85–90% owf. The exhaustion level of the active ALPHASAN® compounds on the target fabrics was about 55–65% of the mix concentration of Alphasan, in excess of 800 ppb on each fabric surface. The sample finished and comparative fabrics were then analyzed for a number of different characteristics, mostly in terms of measurements taken prior to and after a certain number of washes. For each wash test below, the sample fabric was laundered in accordance with modified AATCC Test Method 130-1981, basically with a standard home-type washing machine (Sears Kenmore® Heavy Duty, Super Capacity) equipped with a temperature controller set to wash at 120+/−5° F., or, at higher temperatures, at 140+/−5° F. The rinse temperature was set to cold (70+/−5° F.). Tide® powder detergent was utilized in an amount of about 100 g for a medium load, on a normal cycle (10 minute wash cycle; 28 minute total cycle). The sample fabric was then removed and dried in a standard home dryer on the cotton setting for 10 minutes. None of the produced fabrics above exhibited any electrical conductivity.

In terms of wash durability, all of the Examples above were applied to different fabric samples and tested for bio-available silver via the phosphate buffer comparison test. The Inventive Examples of 1 and 7 were also applied to Nomex and Nylon/cotton blend fabrics for antimicrobial log kill rates.

The surface available silver test measures the amount of active metal ion that freely dissociates from the substrate surface to perform a desired function (such as antimicrobial activity for odor control or reduction or log kill efficacy) and can be performed on washed or unwashed samples to monitor durability of the releasable active ingredient, in this case, silver ions. Surface measurements are followed in order to show the efficaciousness of the target fabric for such purposes since silver ions embedded within the fibers and fabric are not available for antimicrobial and/or antiodor characteristics until they are driven to the surface of the target fibers and/or fabric, generally via increased exposure to moisture (e.g., the greater the number of washes, it has been found that the silver ions are driven out of the fibers and/or fabric to the surface to permit availability for antmicrobial, etc., purposes). The test itself involves subjecting the sample (a swatch of fabric having 4 inch by 4 inch dimensions in this instance) to a phosphate buffer solution made by combining 14.446 g of sodium phosphate dibasic septahydrate and 7.118 g of potassium phosphate monobasic acid and diluting to 1000 g with deionized water. The sample fabrics were exposed to this solution after first being weighed to four significant digits. The exposure was essentially immersion in the solution for 8 hours. After the exposure time, the sample was then dried and weighed again; any loss in weight was then representative of release of the silver ion active ingredient. The calculations are reported as ppm active ingredient on the weight of the sample fabric (this test is herein referred to as "the phosphate buffer comparison test"). The results for the sample fabrics are provided below.

Another indication of the effectiveness of the new binder system for this topical application is the measure of antimicrobial activity of the topical finish after a certain number of washes. Such silver-ion based finishes exhibit excellent antimicrobial activity which can lead to desired odor control, microbe killing, among other benefits. Preferably, effective finish retention (silver-ion release retention) is available when the sample fabric exhibits a log kill rate for *Klebsiella pneumoniae* of at least 1.5, preferably above 2.0, and more preferably above 3.0, both as tested in accordance with a modified AATCC Test Method 100-1993 at elevated temperatures (120–140° F., for instance) for 24 hour exposure, after at least 10 washes, preferably more, as defined above. The results are provided below.

Fabric Treatment

The fabrics utilized, in non-limiting fashion, to show the benefits of this invention were all woven structures as follows: blue 50/50 nylon/cotton ripstop fabric having a weight of 6.5 oz/yd$^2$ (NyCo), a tan 6 oz/yd$^2$ NOMEX® aramid (Nomex), a 6.9 oz/yd$^2$ tan cotton twill (cotton), and a white twill polyester having a weight of 7.5 oz/yd$^2$ (PE).

These fabrics were treated with selected formulations listed above in the INVENTIVE EXAMPLEs and the COMPARATIVE EXAMPLE for testing. The treatment basically involved padding the sample formulation on the treated fabric with a subsequent nip roll. The sample formulation is placed within the pad bath and dried and/or cured (for proper cross-linking, if present) at temperatures between 350–420° F., preferably, 370–400° F.

The following table lists the specific fabrics and sample formulations applied thereto for testing.

TREATED FABRIC TABLE

| Fabric # | Fabric Type | Treatment Formulation (from above) |
|---|---|---|
| 10 | Nomex | INVENTIVE 1 |
| 11 | NyCo | INVENTIVE 2 |
| 12 | PE | INVENTIVE 3 |
| 13 | PE | INVENTIVE 4 |
| 14 | PE | INVENTIVE 5 |
| 15 | Cotton | INVENTIVE 6 |
| 16 | NyCo | INVENTIVE 7 |
| 17 | Nomex | INVENTIVE 7 |
| (Comparatives) | | |
| 18 | Nomex | COMPARATIVE 2 |
| 19 | NyCo | COMPARATIVE 2 |
| 20 | PE | COMPARATIVE 1 |
| 21 | PE | COMPARATIVE 2 |
| 22 | PE | COMPARATIVE 3 |
| 23 | Cotton | COMPARATIVE 4 |

EXPERIMENTAL TABLE 1

Measurements of Surface Available Silver

| Fabric # | # Washes (120° F.) | Ag Ion Retention Level (ppb) | % Ag Ion Retention |
|---|---|---|---|
| 10 | 0 | 2115 | — |
| 10 | 5 | 354 | 16.7 |
| 10 | 10 | 548 | 25.9 |
| 11 | 0 | 1311 | — |
| 11 | 5 | 698 | 53.2 |
| 11 | 10 | 570 | 43.5 |
| 11 | 20 | 231 | 17.6 |
| 12 | 0 | 4180 | — |
| 12 | 10 | 506 | 12.1 |
| 12 | 20 | 238 | 5.7 |
| 13 | 0 | 3890 | — |
| 13 | 10 | 562 | 14.4 |
| 13 | 20 | 251 | 6.5 |
| 14 | 0 | 4290 | — |
| 14 | 10 | 630 | 14.7 |
| 14 | 20 | 271 | 6.3 |
| 15 | 0 | 2150 | — |
| 15 | 10 | 463 | 21.5 |
| 15 | 20 | 167 | 7.8 |
| 16 | 0 | 2050 | — |
| 16 | 5 (140° F.) | 719 | 35.1 |
| 16 | 10 (140° F.) | 446 | 21.8 |
| 16 | 15 (140° F.) | 446 | 21.8 |
| 16 | 20 (140° F.) | 293 | 14.3 |
| 16 | 25 (140° F.) | 208 | 10.1 |
| 16 | 30 (140° F.) | 208 | 10.1 |
| 16 | 35 (140° F.) | 151 | 7.4 |
| 17 | 0 | 2370 | — |
| 17 | 5 (140° F.) | 2277 | 96.1 |
| 17 | 10 (140° F.) | 1387 | 58.5 |
| 17 | 15 (140° F.) | 919 | 38.7 |
| 17 | 20 (140° F.) | 668 | 28.2 |
| 17 | 25 (140° F.) | 680 | 28.7 |
| (Comparatives) | | | |
| 18 | 0 | 2114 | — |
| 18 | 5 | 242 | 11.4 |

EXPERIMENTAL TABLE 1-continued

Measurements of Surface Available Silver

| Fabric # | # Washes (120° F.) | Ag Ion Retention Level (ppb) | % Ag Ion Retention |
|---|---|---|---|
| 18 | 10 | 275 | 13.0 |
| 19 | 0 | 2019 | — |
| 19 | 5 | 435 | 21.5 |
| 19 | 10 | 442 | 21.9 |
| 19 | 20 | 181 | 8.9 |
| 20 | 0 | 4300 | — |
| 20 | 10 | 131 | 3.0 |
| 20 | 20 | 55 | 1.3 |
| 21 | 0 | 4020 | — |
| 21 | 10 | 361 | 9.0 |
| 21 | 20 | 192 | 4.8 |
| 22 | 0 | 4190 | — |
| 22 | 10 | 283 | 6.8 |
| 22 | 20 | 216 | 5.2 |
| 23 | 0 | 2212 | — |
| 23 | 10 | 222 | 10.0 |
| 23 | 20 | 57 | 2.6 |

Thus, the INVENTIVE treatments exhibited more reliable silver-ion retention than the non-cross-linked samples for high temperature wash durability testing for similar binder systems on similar fabrics.

Certain fabrics were tested for bio-available silver under the phosphate buffer comparison test as well, but in terms of different stages of dyed and printed fabric production. Thus, a NyCo fabric was treated with antimicrobial as above in its greige state, then dyed and printed sequentially with vat dyes, and then tested for silver-ion retention after 10 washes under the above-noted modified high-temperature laundering method (Fabric # 30). Another fabric was first vat dyed (after greige), then antimicrobially treated, then printed, and then tested for silver-ion retention (Fabric # 31). Another fabric was first vat dyed and printed, then antimicrobially treated, and then tested for silver-ion retention (Fabric #32). Yet another fabric, this time solution-dyed Nomex (as above), was treated with the antimicrobial and then tested (Fabric #33). The results are as follows:

EXPERIMENTAL TABLE 2

Measurements of Surface Available Silver Ion During Different Fabric Finishing Stages

| Fabric # | # Washes (120° F.) | Ag Ion Retention Level (ppb) | % Ag Ion Retention |
|---|---|---|---|
| 30 | 0 | 2221 | — |
| 30 | 5 | 1121 | 50.5 |
| 30 | 10 | 849 | 38.2 |
| 31 | 0 | 1118 | — |
| 31 | 5 | 829 | 74.2 |
| 31 | 10 | 612 | 54.7 |
| 32 | 0 | 4880 | — |
| 32 | 5 | 1332 | 27.3 |
| 32 | 10 | 669 | 13.7 |
| 33 | 0 | 2629 | — |
| 33 | 5 | 1319 | 50.2 |
| 33 | 10 | 820 | 31.2 |

Thus, antimicrobial application on target fabrics may be performed at any step during the fabric finishing process and still provide effective efficacy in terms of silver-ion retention. Generally, the higher the percentage of silver-ion retention, the more effective odor and/or antimicrobial control.

As noted above, actual log kill rate testing was performed for INVENTIVE EXAMPLES 1 and 7, thus, fabrics 10 and 16, for *K. pneumoniae*. The results were as follows (with Control samples meaning no antimicrobial added):

EXPERIMENTAL TABLE 3

Log Kill Rates for *K. pneumoniae*

| Fabric # | # Washes (120° F.) | Log Kill Rate for *K. pneumoniae* |
|---|---|---|
| 10 | 25 | 3.26 |
| 10 | 50 | 4.09 |
| 16 | 5 | 1.69 |
| 16 | 10 | 2.26 |
| 16 | 15 | 4.60 |
| 16 | 20 | 2.92 |
| (Comparatives) | | |
| Nomex Control | — | −0.95 |
| NyCo Control | — | −0.53 |

Thus, these sample inventive fabrics exhibited excellent high-temperature wash durability as well, particularly in terms of actually microorganism reduction.

There are, of course, many alternative embodiments and modifications of the present invention which are intended to be included within the spirit and scope of the following claims.

What is claimed is:

1. A fabric substrate having a surface, a portion of which is coated with a non-electrically conductive finish, wherein said finish consists essentially of:

(a) at least one silver-ion containing compound selected from the group consisting of silver zirconium phosphate compounds;

(b) at least one cross-linked binder material selected from the group consisting of polyurethane binder compounds; and (c) a cross-linking agent selected from the group consisting of epoxy-based compounds.

2. A fabric substrate having a surface, a portion of which is coated with a finish, wherein said finish consists essentially of:

(a) at least one silver-ion containing compound selected from the group consisting of silver zirconium phosphate compounds;

(b) at least one cross-linked binder material selected from the group consisting of a polyurethane binder compounds; and (c) a cross-linking agent selected from the group consisting epoxy-based compounds; and (d) at least one halide-ion containing compound selected from the group consisting of magnesium chloride compounds, wherein the molar ratio of halide ions to silver ions is within the range of from 1:10 to 5:1, and wherein said finish is substantially free from alkali metal ions.

* * * * *